US007150318B2

(12) United States Patent
Freeman

(10) Patent No.: US 7,150,318 B2
(45) Date of Patent: Dec. 19, 2006

(54) APPARATUS FOR ACTUATING A WELL TOOL AND METHOD FOR USE OF SAME

(75) Inventor: Tommie A. Freeman, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 10/680,526

(22) Filed: Oct. 7, 2003

(65) Prior Publication Data

US 2005/0072577 A1 Apr. 7, 2005

(51) Int. Cl.
*E21B 43/12* (2006.01)

(52) U.S. Cl. ..... 166/255.1; 166/387; 166/66.7; 166/65.1; 166/386

(58) Field of Classification Search ..... 166/255.1, 166/381, 386, 387, 65.1, 66.6, 66.7; 405/184.1, 405/184.3, 184.4
See application file for complete search history.

(56) References Cited

U.S. PATENT DOCUMENTS

| | | | | |
|---|---|---|---|---|
| 4,149,566 | A | 4/1979 | Stowe | |
| RE31,155 | E | 2/1983 | Crocker | |
| 4,569,396 | A | 2/1986 | Brisco | |
| 4,676,310 | A | 6/1987 | Scherbatskoy et al. | |
| 5,305,833 | A | 4/1994 | Collins | |
| 5,641,023 | A | 6/1997 | Ross et al. | |
| 5,678,633 | A | 10/1997 | Constantine, Jr. | |
| 5,947,213 | A | 9/1999 | Angle et al. | |
| 6,003,606 | A * | 12/1999 | Moore et al. | 166/381 |
| 6,024,173 | A | 2/2000 | Patel et al. | |
| 6,026,911 | A | 2/2000 | Angle et al. | |
| 6,112,809 | A | 9/2000 | Angle | |
| 6,273,189 | B1 | 8/2001 | Gissler et al. | |
| 6,279,658 | B1 | 8/2001 | Donovan et al. | |
| 6,378,627 | B1 | 4/2002 | Tubel et al. | |
| 6,405,798 | B1 | 6/2002 | Barrett et al. | |
| 6,431,270 | B1 | 8/2002 | Angle | |
| 6,446,718 | B1 | 9/2002 | Barrett et al. | |
| 6,675,888 | B1 * | 1/2004 | Schempf et al. | 166/65.1 |
| 6,953,094 | B1 * | 10/2005 | Ross et al. | 166/381 |
| 2003/0075321 | A1 | 4/2003 | Hall | |

FOREIGN PATENT DOCUMENTS

| | | |
|---|---|---|
| WO | WO 02/44509 | 6/2002 |
| WO | WO 2004/072433 | 8/2004 |

OTHER PUBLICATIONS

"Selective Injection Packer (SIP) Tools"; Halliburton Energy Services, Inc.; Sep. 14, 2001; 77 pages.

* cited by examiner

*Primary Examiner*—William Neuder
*Assistant Examiner*—Matthew J. Smith
(74) *Attorney, Agent, or Firm*—Lawrence R. Youst

(57) ABSTRACT

An apparatus (60) for actuating a well tool (148) in a wellbore includes a downhole robot (62) that provides for locomotion within the wellbore (144). A pressure control member (64) having a deployed position is operably associated with the downhole robot (62). An engagement mechanism (66) is operably associated with the downhole robot (62) and releasably engages with the well tool (148) such that when the engagement mechanism (66) engages the well tool, the pressure control member (64) is in the deployed position and a differential pressure is created across the pressure control member (64), the downhole robot (62) transmits a longitudinal force to actuate the well tool (148).

73 Claims, 6 Drawing Sheets

APPARATUS FOR ACTUATING A WELL TOOL AND METHOD FOR USE OF SAME

TECHNICAL FIELD OF THE INVENTION

This invention relates, in general, to actuating well tools and, in particular, to an apparatus that provides for actuating a well tool positioned within a wellbore with the use of a downhole robot that provides for locomotion and longitudinal force operations within the wellbore.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled.

Once this well construction process is finished, the completion process may begin. The completion process comprises numerous steps including creating hydraulic openings or perforations through the production casing string, the cement and a short distance into the desired formation or formations so that production fluids may enter the interior of the wellbore. The completion process may also include installing a production tubing string within the well casing which is used to produce the well by providing the conduit for formation fluids to travel from the formation depth to the surface.

To selectively permit and prevent fluid flow into the production tubing string, it is common practice to install one or more sliding sleeve type flow control devices within the tubing string. Typical sliding sleeve type flow control devices comprise a generally tubular body portion having side wall inlet openings formed therein and a tubular flow control sleeve coaxially and slidably disposed within the body portion. The sleeve is operable for axial movement relative to the body portion between a closed position, in which the sleeve blocks the body inlet ports, and an open position, in which the sleeve uncovers the ports to permit fluid to flow inwardly therethrough into the interior of the body and thus into the interior of the production tubing string. The sliding sleeves thus function as movable valve elements operable to selectively permit and prevent fluid inflow. Generally, cylindrical shifter tools, coaxially lowered into the interior of the tubing string on a conveyance such as a wireline, slickline or coiled tubing, are utilized to shift selected ones of the sliding sleeves from their closed positions to their open positions, or vice versa, to provide subsurface flow control in the well.

It has been found, however, the once a sliding sleeve flow control device has been positioned within the wellbore for an extended period of time, the slidable sleeve may become stuck in a particular operational state and therefore difficult to actuate. In addition, even normal actuation operations may place significant demands on the integrity and strength of the shifting tool and the conveyance in wells that are deep, deviated, inclined or horizontal due to elongation of the conveyance and added frictional effects.

Accordingly, prior art shifting tools and conveyances can apply only a limited amount of shifting force to actuate a sliding sleeve flow control device previously placed into the wellbore. Therefore, a need has arisen for a shifting tool that will provide for the exertion of a greater shifting force such that well tools that are stuck in a particular operational state can be actuated. A need has also arisen for such a shifting tool that will produce the necessary force to actuate well tools positioned in deep, deviated, inclined or horizontal wellbores.

SUMMARY OF THE INVENTION

The present invention disclosed herein comprises an apparatus and method for actuating a well tool. The apparatus and method of the present invention provide for the exertion of a greater shifting force such that well tools that are stuck in a particular operational state can be actuated. Moreover, the apparatus of the present invention produces the necessary force to actuate well tools positioned in deep, deviated, inclined or horizontal wellbores. In particular, the apparatus of the present invention employs a downhole robot that utilizes a differential pressure created across a pressure control member in order to transmit a longitudinal force to actuate the well tool.

In one aspect, the present apparatus is directed to an apparatus for actuating a well tool that includes a downhole robot that provides locomotion within the wellbore. The downhole robot has a pressure control member operably associated therewith that has a running position and a deployed position. In the deployed position, a differential pressure can be created across the pressure control member. An engagement mechanism is operably associated with the downhole robot and is releasably engageable with the well tool. When the engagement mechanism engages the well tool, the pressure control member is in the deployed position and a differential pressure is created thereacross, the downhole robot transmits a longitudinal force to actuate the well tool.

In one embodiment, the downhole robot comprises a locomotor assembly including drive mechanism that is operable to contact the wellbore. The downhole robot may comprise a self-contained power source for providing electrical power. Alternatively, an umbilical cord may supply control and power to the downhole robot. The downhole robot may comprise a control unit that provides for the operation of the downhole robot, the pressure control member and the engagement mechanism. Additionally, the downhole robot may include a position sensor for determining the location of the downhole robot within the wellbore. The pressure control member may comprise a seal operable to radially expand into a sealing engagement with the wellbore such that the differential pressure created thereacross provides the apparatus of the present invention with a mechanical advantage to transmit the longitudinal force to the well tool.

The pressure control member may comprise a seal including a rubber element bonded to a metal element that may take the form of a cup-like design. The pressure differential may be a pressure uphole of the downhole robot that is greater than a pressure downhole of the downhole robot. Alternatively, the pressure differential may be a pressure downhole of the downhole robot that is greater than a pressure uphole of the downhole robot. The engagement mechanism may include at least one key operable to mate with a matching profile associated with the well tool.

In another aspect, the present invention is directed to a method for actuating a well tool previously positioned in a wellbore. The method includes positioning a downhole robot having a pressure control member and an engagement mechanism within the wellbore, moving the downhole robot within the wellbore to a location proximate the well tool, releasably engaging the engagement mechanism with the well tool, creating a differential pressure across the pressure control member and transmitting a longitudinal force with the engagement mechanism to actuate the well tool.

In a further aspect, the present invention is directed to an apparatus for actuating a tool positioned within a tubular that includes a robot that provides locomotion within the tubular. A pressure control member is operably associated with the robot and has a deployed position. An engagement mechanism is operably associated with the robot and is releasably engageable with the tool such that when the engagement mechanism is engaged with the tool, the pressure control member is in the deployed position and a differential pressure is created thereacross, the robot transmits a longitudinal force to actuate the tool.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
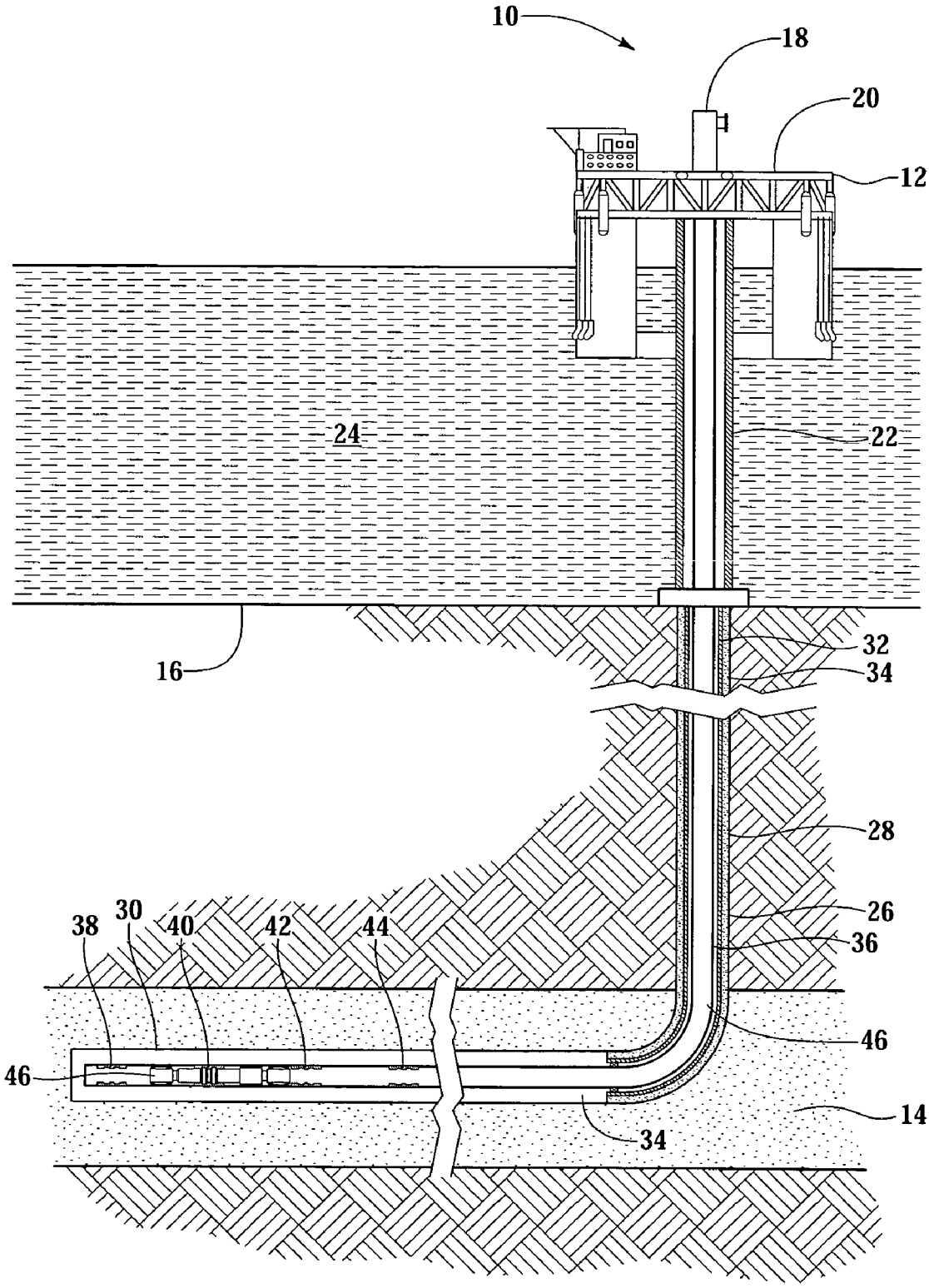
FIG. 1 is a schematic illustration of an offshore oil and gas platform operating an apparatus for actuating a well tool according to the present invention.

Referring initially to FIG. 1, an apparatus for actuating a well tool of the present invention is being operated from an offshore oil and gas platform that is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26.

Wellbore 26 has a generally vertical portion 28 and a generally horizontal portion 30 that extends through formation 14. A casing 32 is cemented within vertical portion 28 of wellbore 26 by cement 34. Disposed within casing 34 and extending from wellhead 18 into open hole portion 30 is production tubing 36. A series of well tools illustrated as sliding sleeves 38, 40, 42, 44 are positioned within tubing 36. Sliding sleeves 38, 40, 42, 44 may be infinitely variable sliding sleeves that control fluid flow therethrough between a fully open position and a closed position such that production fluids from formation 14 are selectively allowed to enter the interior of tubing 36. In the illustrated embodiment, it is desired to actuate sliding sleeve 40 from a first operational state, the fully open position, to a second operational state, a partially or fully closed position. As part of the actuation operation of sliding sleeve 40, an apparatus for actuating a well tool 46 has moved to a location proximate sliding sleeve 40 in order to apply a longitudinal force to the sliding sleeve 40.

As those skilled in the art will understand, if sliding sleeve 40 becomes stuck in one of its operational states, the force required to shift sliding sleeve 40 to another of its operational states may be high and may exceed the force which can be applied thereto by conventional wireline shifting tools or robotic units. In particular, in a horizontal or deviated wellbore, existing wirelines and shifting tools, can not produce the necessary force to shift the sliding sleeve. In addition, conventional robotic units are unable to apply a sufficient force to shift the sliding sleeve due to the low friction force between the tubular walls and the drive portions of the robotic units. Apparatus 46 of the present invention, however, can be used to apply the required force to shift sliding sleeve 40 from an existing operational state to its desired operational state even if sliding sleeve 40 has become stuck in its existing operational state. This is achieved by positioning apparatus 46 at sliding sleeve 40, releasably engaging sliding sleeve 40 with an engagement mechanism, actuating a pressure control member of apparatus 46 that allows the creation of a differential pressure thereacross and utilizing the mechanical advantage afforded by the differential pressure to transmit a longitudinal force via the engagement mechanism to actuate sliding sleeve 40. Although the apparatus 46 is depicted as shifting a sliding sleeve, it will be appreciated by those skilled in the art that apparatus 46 may actuate other types of well tools from one operational state to another operational state including, but not limited to, chokes, valves and other flow control or safety devices used during a variety of well operations including drilling, completion and production.

Figure 2:
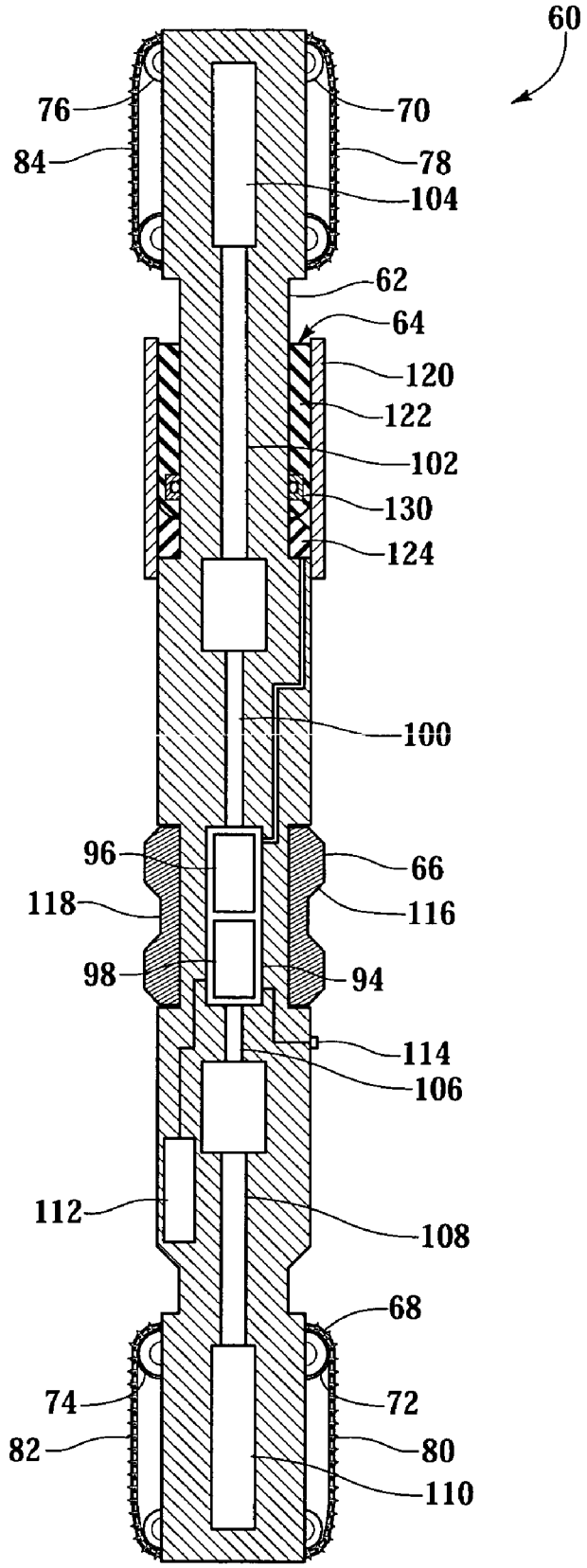
FIG. 2 is a schematic diagram of an apparatus for actuating a well tool according to the present invention.

Referring now to FIG. 2, therein is schematically depicted an apparatus for actuating a well tool of the present invention that is generally designated 60. Apparatus 60 includes a downhole robot 62, a pressure control member 64 and an engagement mechanism 66, each of which will be discussed in greater detail hereinbelow. Downhole robot 62 includes a locomotor assembly 68 that provides for the movement of downhole robot 62 through the wellbore regardless of the directional characteristics of the wellbore including vertical, horizontal or deviated wellbores. Locomotor assembly 68 has a plurality of drive mechanisms illustrated as tractors 70, 72, 74, 76 that are visible in the view presented in FIG. 2. Tractors 70, 72, 74, 76 have endless chains or belt treads 78, 80, 82, 84, respectively, that are operable to contact the interior wall of the tubular or wellbore in which downhole robot 62 is deployed. Alternatively, the drive mechanisms may include wheels or other suitable drive means. The drive mechanism may also include suspension members coupled between downhole robot 62 and tractors 70, 72, 74, 76, respectively, in order to provide a system of springs and shock absorbers that support downhole robot 62 while tractors 70, 72, 74, 76 are operating in a running gear.

A control unit 94 is associated with downhole robot 62 and includes a motor 96 and a microcontroller 98. Motor 96 may be an electrical motor that drives shafts 100, 102 which transmit power to a gear assembly 104 which powers tractors 70, 76. Similarly, motor 96 drives shafts 106, 108 which transmit power to a gear assembly 110 which powers tractors 72, 74. Although a specific arrangement of four tractors 70, 72, 74, 76 has been illustrated, it should be appreciated that the locomotion may be achieved by any arrangement providing autonomous movement.

Microcontroller 98 is made of suitable electrical components to provide miniaturization and durability within the high pressure, high temperature environments which can be encountered in an oil or gas well and is used to control the operation of apparatus 60. Microcontroller 98 is preferably housed within the structure of control unit 94. In one embodiment, microcontroller 98 includes a microprocessor which operates under control of a timing device and a program stored in a memory. The program in the memory includes instructions which cause the microprocessor to control apparatus 60.

Microcontroller 98 operates under power from a power supply which can be at the surface of the well or, preferably, contained within downhole robot 62. For a particular implementation, a battery 112 serves as the power supply and provides the electrical power to both motor 96 of downhole robot 62 and microcontroller 98. One or more sensors, such as sensor 114, monitor the operation downhole of apparatus 60 and provide responsive signals to microcontroller 98 relative to the downhole conditions and the downhole location of apparatus 60, for example. Sensors may include temperature sensors, pressure sensors, or an inclinometer, for example. When apparatus 60 is positioned within the wellbore, microcontroller 98 commences operation of apparatus 60 as programmed. For example, microcontroller 98 sends a command to energize motor 96 in order to power locomotor assembly 68 and move apparatus 60 to the target location. Once at the target location, microcontroller 98 continues to operate apparatus 60. For example, with regard to controlling motor 96 that operates the engagement mechanism 66, microcontroller 98 sends a command to energize motor 96 to lock engagement mechanism 66 into the matching profile of the wellbore tool. When microcontroller 98 determines that a desired result has been obtained, it stops operation of apparatus, such as by de-energizing motor 96 of the exemplified implementation.

In the illustrated embodiment, engagement mechanism 66 includes a plurality of actuatable keys, only keys 116, 118 being visible, which correspond to a matching profile on the well tool. Keys 116, 118 are under the control of control unit 98 and are releasably engageable with the well tool. Upon engaging the well tool, engagement mechanism 66 serves as an anchor to maintain the position of apparatus 60 in the wellbore relative to the well tool. In one embodiment, keys 116, 118 may comprise specifically-shaped projections that fit correspondingly shaped shoulder and slot arrangements associated with the well tool. Keys 116, 118 may be spring mounted and triggered to lock with the matching profile of the well tool upon signaling from control unit 94 or may automatically latch into the matching profile if keys 116, 118 have been deployed in a hunt mode. Even though engagement mechanism 66 has been depicted as a plurality of actuatable keys, it should be understood by those skilled in the art that other types of engagement members may be used in conjunction with the present invention including, but not limited to, engagement members having collet members, lugs, no-gos, dogs and the like that are capable of at least temporarily coupling robot 62 and the well tool.

Pressure control member 64 is illustrated in a running position wherein pressure control member 64 is biased against sleeve 120 which maintains pressure control member in the running position. Pressure control member 64 includes seal members 122, 124 mounted exteriorly on downhole robot 62. Seal members 122, 124 are preferably made from an extrudable material such as elastomers or rubbers. For example, seal members 122, 124 may be subjected to a crosslinking reaction to increase the strength and resiliency of the extrudable material. The crosslinking reaction may be vulcanization, a radiation crosslinking reaction, a photochemical crosslinking reaction, a chemical crosslinking reaction, or other reaction known in the art. Preferably, when seal member 122 is in the deployed or sealing position, seal member 122 has a cup-like design that may take the form of a cylindrical element having a closed end and an open or hollowed-out end. The cylindrical element is positioned such that a differential pressure may be created thereacross which in turn creates a force which urges keys 116, 118 in a direction from the open end to the closed end. In the illustrated embodiment, a support element 130 provides structural integrity to pressure control member 64. Support element 130 is preferably a steel alloy fashioned into a ring having enough integrity to provide an effective back-stop to seal member 122.

In one embodiment, seal member 122 includes an elastomeric sleeve which has at one end thereof a belled or flared end which has an enlarged diameter as compared to the remaining portion of the elastomeric sleeve. The elastomeric sleeve defines an axial bore which extends centrally through the sleeve from one end thereof to the other. At the end opposite the belled end, the elastomeric sleeve includes a planar face which lies in a plane extending transversely with respect to the axis of the elastomeric sleeve. Upon actuation, within the belled end of the elastomeric sleeve, a generally V-shaped fluid-receiving cavity is present. Concentrically positioned within the fluid-receiving cavity and the planar face is support element 130 which is a steel or similarly rigid material which provides reinforcement. Seal member 124 comprises an elastomeric material that provides additional support and reinforcement to seal member 122.

Figure 3:
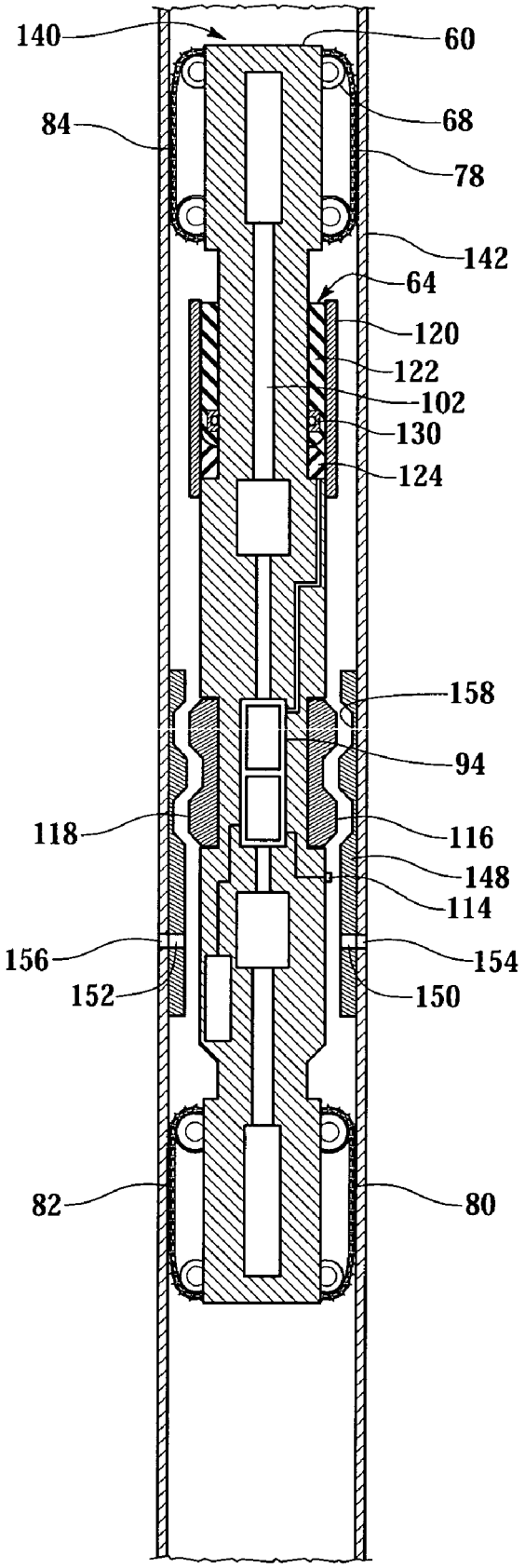
FIG. 3 is a sectional view of an apparatus for actuating a well tool according to the present invention in a first operational position.

FIG. 3 depicts apparatus 60 for actuating a well tool according to the present invention in a first operational position which is designated 140. A tubing 142 is positioned in an open hole completion within a wellbore and a well tool in the form of a sliding sleeve 148 is positioned in tubing 142. Openings 150, 152 of sliding sleeve 148 are aligned with openings 154, 156 of tubing 142 to allow production fluids to flow from the formation into tubing 142.

Operations are initiated by the release of apparatus 60 from a wellhead. Alternatively, a conveyance, such as a wireline, may be employed to lower apparatus 60 via gravity a distance into wellbore 144 and operations may commence at the release of apparatus 60 from the conveyance. During operations, apparatus 60 moves uphole and downhole following instructions relayed to the apparatus or instructions stored in control unit 94 of apparatus 60. In the illustrated embodiment, locomotor assembly 68 of the downhole robot has appropriately autonomously moved apparatus 60 downhole to its target location in tubing 142 which is proximate sliding sleeve 148 and is preparing to engage sliding sleeve 148. Apparatus 60 may use sensor 114 to determine the location of apparatus 60 within wellbore 144. Alternatively, control unit 94 may determine the location of apparatus 60 within wellbore 144 by monitoring the rotations of treads 78, 80, 82, 84. Regardless of the method employed to determine the location of apparatus 60, apparatus 60 is at the target location when keys 116, 118 align with matching profile 158 of sliding sleeve 148.

Figure 4:
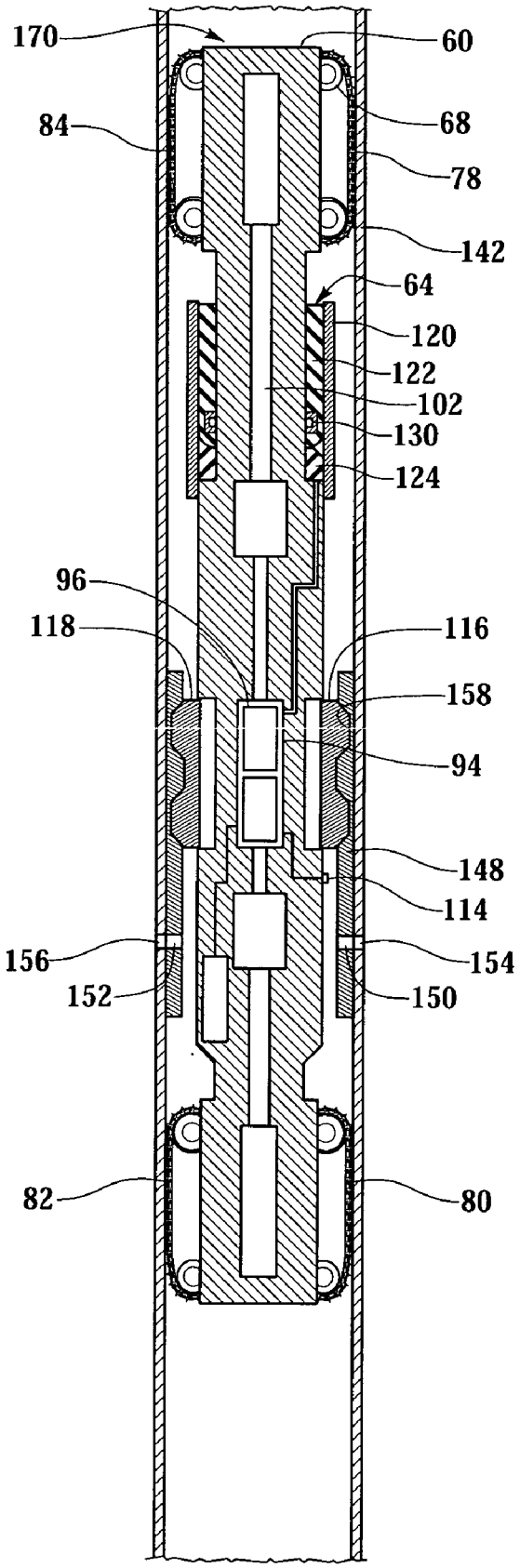
FIG. 4 is a sectional view of the apparatus for actuating the well tool according to the present invention in a second operational position.

FIG. 4 depicts apparatus 60 for actuating the well tool according to the present invention in a second operational position which is generally designated 170. As illustrated, apparatus 60 has engaged matching profile 158 of sliding sleeve 148 with keys 116, 118 and is longitudinally secured within tubing 142 by the engagement of keys 116, 118 with matching profile 158 of sliding sleeve 148. More specifically, control unit 94 has temporarily instructed motor 96 to cease locomotion and instructed motor 96 to lock the releasably engageable keys 116, 118 with matching profile 158. Upon the mating of keys 116, 118 with matching profile 158, apparatus 60 is anchored relative to sliding sleeve 148.

Figure 5:
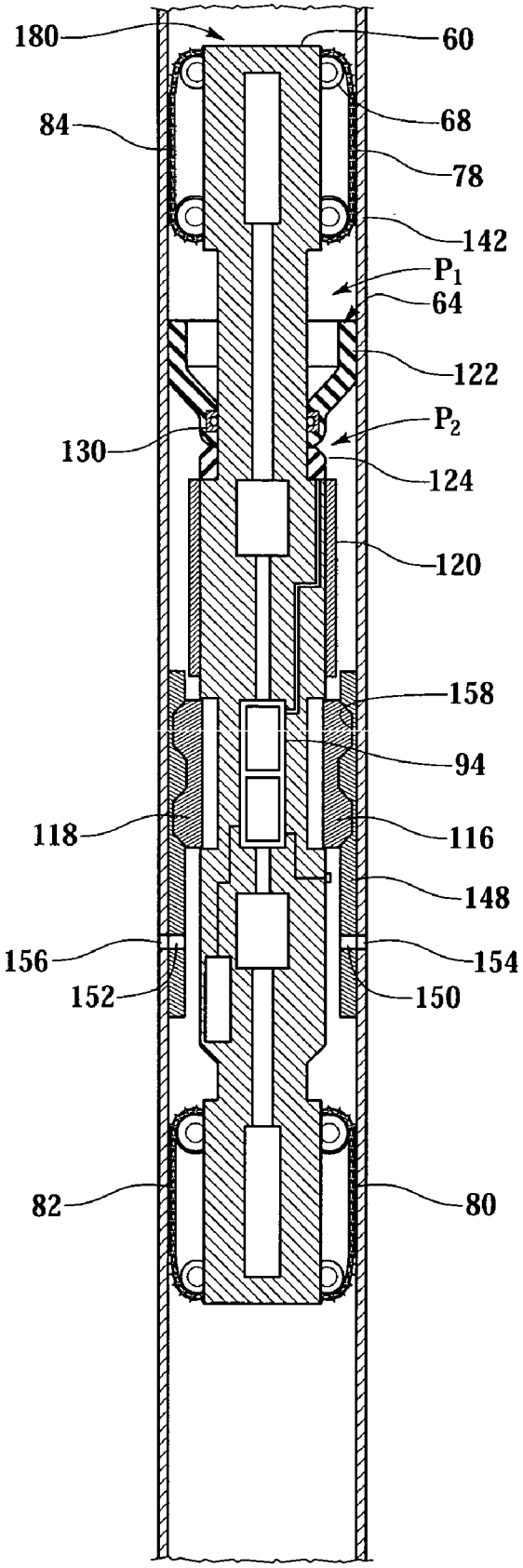
FIG. 5 is a sectional view of the apparatus for actuating the well tool according to the present invention in a third operational position.

FIG. 5 depicts apparatus 60 for actuating the well tool according to the present invention in a third operational position, which is designated 180. Once engagement mechanism 66, i.e., keys 116, 118, are longitudinally secured and have engaged sliding sleeve 148, control unit 98 signals sleeve 120 to retract into a setting position so that seal member 122 held biased against sleeve 120 radially expands into a sealing engagement with tubing 142. Once seal member 122 is actuated and in a sealing engagement with tubing 142, a differential pressure is created across seal member 122 by, for example, increasing the pressure uphole of robot 62. Specifically, as indicated in the illustration by the pressure designations $P_1$ and $P_2$, wherein $P_1>P_2$, $P_1$ is increased to a level sufficiently higher than $P_2$ by, for example, pumping a compressible or incompressible fluid into tubing 142 at the surface.

Figure 6:
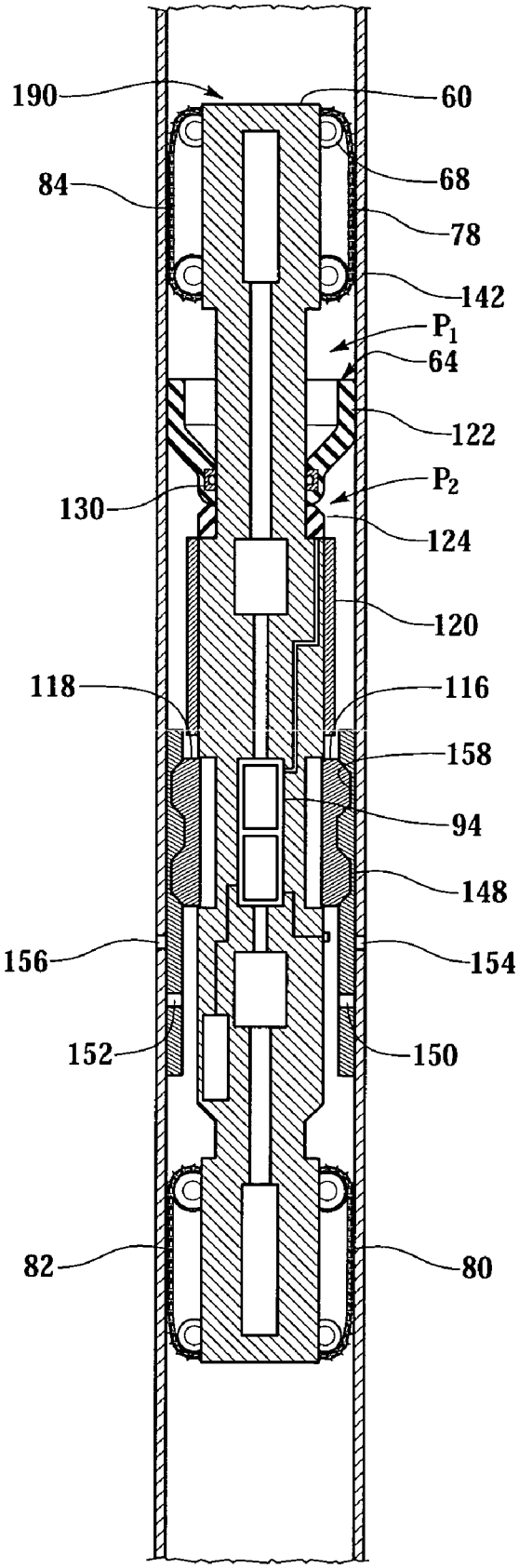
FIG. 6 is a sectional view of the apparatus for actuating the well tool according to the present invention in a fourth operational position.

FIG. 6 depicts apparatus 60 for actuating the well tool according to the present invention in a fourth operational position, designated 190, wherein apparatus 60 is leveraging the mechanical advantage created by the pressure differential across pressure control member 64 to shift sliding sleeve 148 from the open position wherein openings 150, 152 are aligned with openings 154, 156 to the closed position wherein openings 150, 152 are not aligned with openings 154, 156. In particular, using the differential pressure, apparatus 60 transmits a longitudinal force to sliding sleeve 148 by way of the interlocked keys 116, 118 and matching profile 158. As illustrated, apparatus 60 shifts sliding sleeve 148 downwardly in order to actuate sliding sleeve 148 from the open position to the closed position thereby preventing production flow therethrough.

As previously mentioned, existing shifting tools, such as wireline operated shifting tools, can only apply a limited amount of shifting force to a well tool previously placed in a wellbore. By establishing a seal across tubing 124, creating a pressure differential thereacross and utilizing the pressure differential to apply a longitudinal shifting force, well tools may be actuated between operational states, even if such well tools have become stuck in their present operational state. In addition, the force required to actuate a well tool, such as a stuck sliding sleeve, typically exceeds the force that may be generated by a conventional downhole robot's ability to grip the wellbore and pull against the same grip in order to actuate the well tool. By creating a differential pressure across the apparatus of the present invention, a mechanical advantage is created such that the downhole robot may actuate the stuck well tool.

Figure 7:
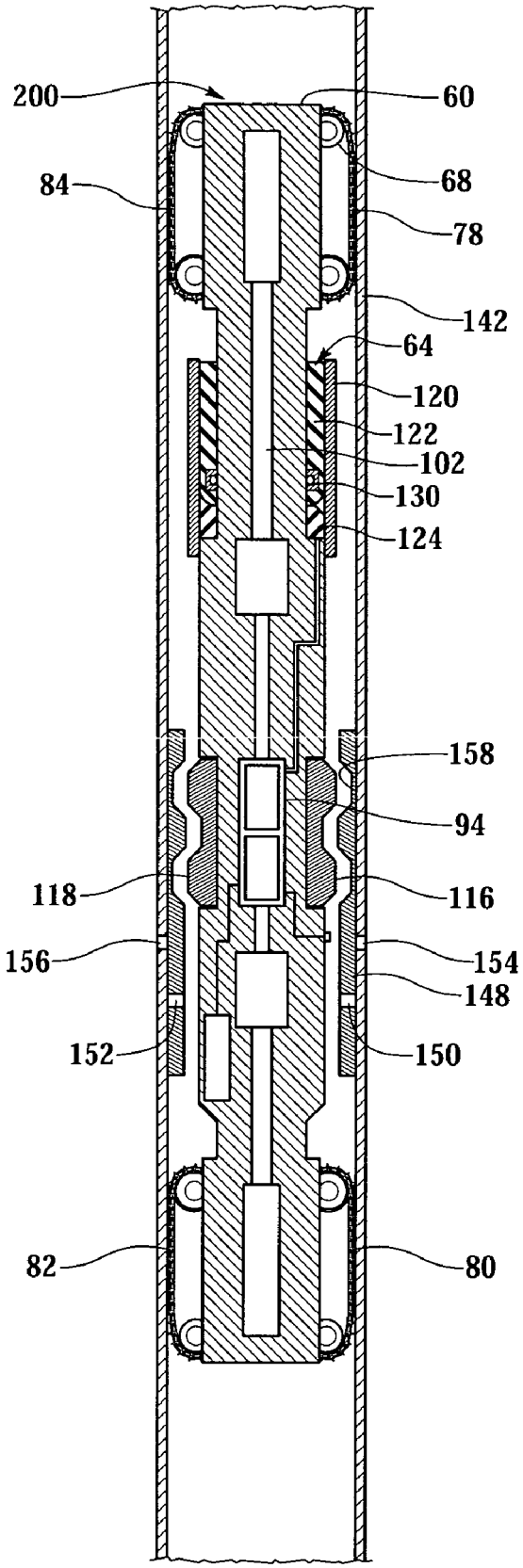
FIG. 7 is a sectional view of the apparatus for actuating the well tool according to the present invention in a fifth operational position.

FIG. 7 depicts apparatus 60 for actuating the well tool according to the present invention in a fifth operational position which is designated 200. As apparatus 60 has actuated sliding sleeve 148 by moving sliding sleeve 148 from a first operational position wherein openings 150, 152 of sliding sleeve are aligned with openings 154, 156 of tubing 142 to a second operational position wherein openings 150, 152 are not aligned with openings 154, 156, apparatus 60 has completed the actuation of sliding sleeve 148. Control unit 94 signals sleeve 120 to reposition seal members 122, 124 from the sealing position to the running position. Additionally, control unit 94 signals keys 116, 118 to disengage from matching profile 158. At this time apparatus 60 is again in the running position and may autonomously reposition itself within the wellbore in order to actuate another well tool or return to the surface.

Figure 8:
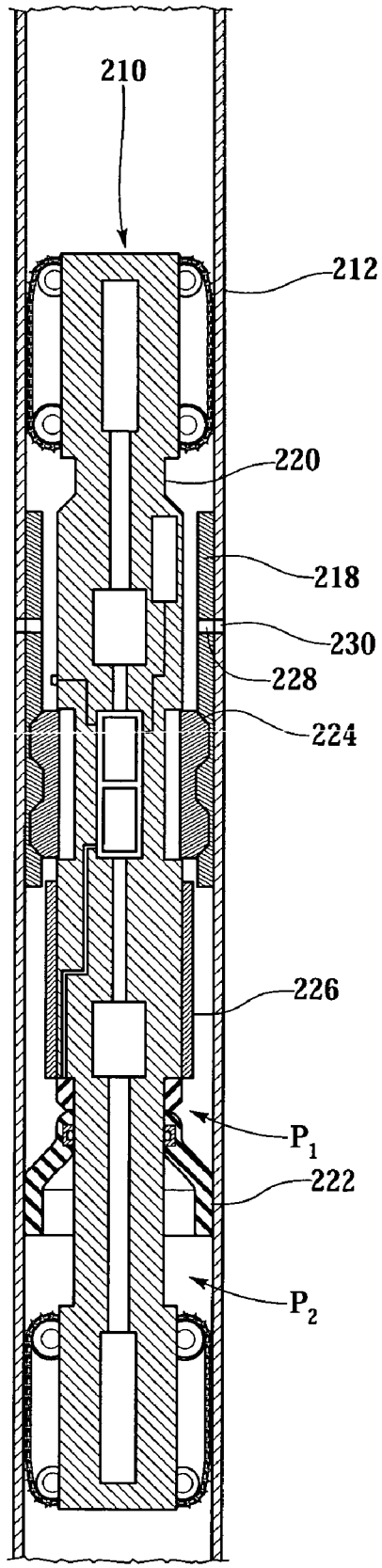
FIG. 8 is a sectional view of an alternate embodiment of the apparatus for actuating a well tool according to the present invention.

FIG. 8 depicts an alternate embodiment of an apparatus 210 for actuating a well tool according to the present invention. A tubing 212 is positioned within an open hole completion within a wellbore and a well tool in the form of a sliding sleeve 218 is positioned in tubing 212. Sliding sleeve 218 was in the closed position and apparatus 210 has been deployed in order to actuate sliding sleeve 218 to the depicted open position. Similar to apparatus 60 described hereinabove, apparatus 210 includes a downhole robot 220, a pressure control member 222 and an engagement mechanism 224. In the illustrated embodiment, contrary to the arrangement described hereinabove, pressure control member 222 is positioned such that a differential pressure across pressure control member 222 creates a longitudinal force in the uphole direction. In particular, a sleeve 226 is retracted and pressure control member 222, which is illustrated as a two-part seal member, is in a sealing position sealed against tubing 212. A differential pressure is created across the pressure control member 222 as indicated in the illustration by the pressure designations $P_1$ and $P_2$, wherein $P_2>P_1$. In the illustration, apparatus 210 utilizes the mechanical advantage afforded by pressure control member 222 to shift sliding sleeve 218 in the uphole direction such that openings 228 of sliding sleeve 218 align with openings 230 of tubing 212. In this embodiment, the pressure source used to create the differential pressure may be formation pressure from a location downhole of apparatus 210.

Figure 9:
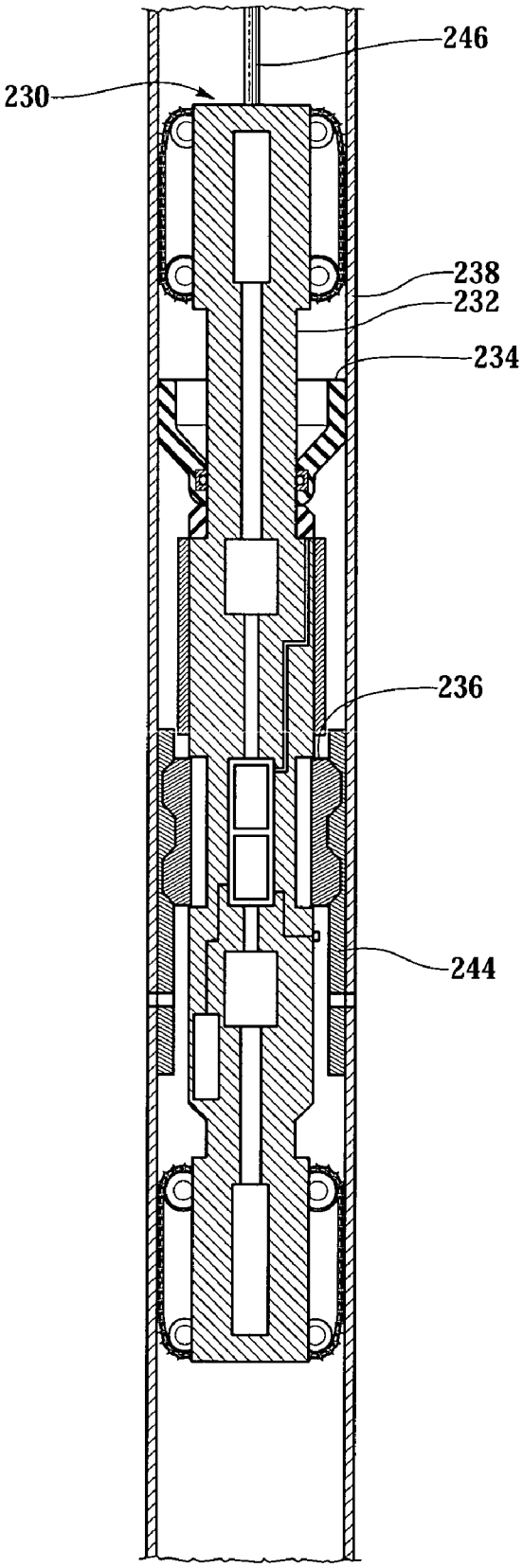
FIG. 9 is a sectional view of another alternate embodiment of the apparatus for actuating a well tool according to the present invention.

FIG. 9 depicts another alternate embodiment of an apparatus 230 for actuating a well tool according to the present invention. Apparatus 230 includes a downhole robot 232, a pressure control member 234 and an engagement mechanism 236. A tubing 238 is positioned within an open hole completion within a wellbore and a well tool in the form of a sliding sleeve 244 is positioned in tubing 238. In the illustrated embodiment, an umbilical cord 246 is coupled to downhole robot 232 in order to supply control and power to apparatus 230. The illustrated apparatus 230 has all of the functionalities of the aforementioned apparatuses of the present invention.

Figure 10:
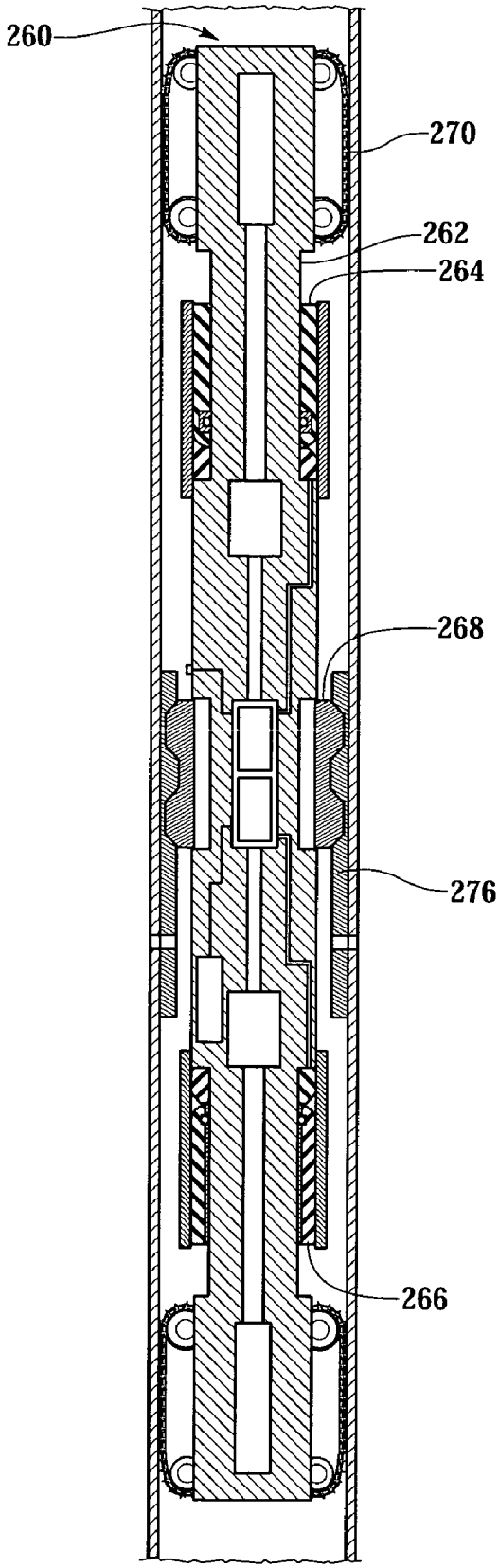
FIG. 10 is a sectional view of a further alternate embodiment of the apparatus for actuating a well tool according to the present invention.

FIG. 10 depicts a further alternate embodiment of an apparatus 260 for actuating a well tool according to the present invention. Apparatus 260 includes a downhole robot 262, two pressure control members 264, 266 and an engagement mechanism 268. A tubing 270 is positioned within a wellbore and a well tool in the form of a sliding sleeve 276 is positioned in tubing 270. Opposing pressure control members 264, 266 are positioned uphole and downhole of engagement mechanism 268, respectively. In the illustrated configuration, apparatus 260 may actuate sliding sleeve 276 by creating a longitudinal force in either the uphole or downhole direction by selectively operating either pressured control member 266 or pressure control member 264, respectively. This bi-directional embodiment of the apparatus for actuating a well tool of the present invention increases the range of operations that may be performed during a single deployment.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for actuating a well tool within a wellbore comprising:

a downhole robot that provides locomotion within the wellbore;

a pressure control member operably associated with the downhole robot, the pressure control member including a seal operable to radially expand into a sealing engagement with the wellbore when the pressure control member is in a deployed position; and an engagement mechanism operably associated with the downhole robot and releasably engageable with the well tool, the engagement mechanism having at least one key operable to mate with a matching profile associated with the well tool.

2. The apparatus as recited in claim 1 wherein the downhole robot further comprises a locomotor assembly including a drive mechanism operable to contact the wellbore.

3. The apparatus as recited in claim 1 wherein the downhole robot further comprises a self-contained power source for providing electrical power.

4. The apparatus as recited in claim 1 further comprising an umbilical cord operably associated with the downhole robot, the umbilical cord supplying control and power to the downhole robot.

5. The apparatus as recited in claim 1 wherein the downhole robot further comprises a control unit that provides for the operation of the downhole robot, the pressure control member and the engagement mechanism.

6. The apparatus as recited in claim 1 wherein the downhole robot further comprises a position sensor for determining the location of the downhole robot within the wellbore.

7. The apparatus as recited in claim 1 wherein the well tool further comprises a sliding sleeve flow control device.

8. The apparatus as recited in claim 1 wherein the seal further comprises a rubber element and a metal element.

9. The apparatus as recited in claim 1 wherein the seal further comprises a cup-shaped seal.

10. The apparatus as recited in claim 1 wherein a pressure differential is selectively created across the pressure control member when the pressure control member is in the deployed position by establishing a pressure uphole of the downhole robot that is greater than a pressure downhole of the downhole robot.

11. The apparatus as recited in claim 1 wherein a pressure differential is selectively created across the pressure control member when the pressure control member is in the deployed position by establishing a pressure downhole of the downhole robot that is greater than a pressure uphole of the downhole robot.

12. The apparatus as recited in claim 1 wherein the pressure control member has a running position.

13. The apparatus as recited in claim 1 wherein the pressure control member further comprises a pair of oppositely disposed seals operable to allow the selective creation of bi-directional differential pressures.

14. An apparatus for actuating a well tool within a wellbore comprising:

a downhole robot that provides locomotion within the wellbore;

a pressure control member operably associated with the downhole robot, the pressure control member having a deployed position; and an engagement mechanism operably associated with the downhole robot and releasably engageable with the well tool such that when the engagement mechanism is engaged with the well tool, the pressure control member is in the deployed position and a differential pressure is created thereacross, the downhole robot transmits a longitudinal force to actuate the well tool.

15. The apparatus as recited in claim 14 wherein the pressure control member further comprises a seal operable to radially expanded into a sealing engagement with the wellbore when the pressure control member is in the deployed position.

16. The apparatus as recited in claim 15 wherein the seal further comprises a rubber element and a metal element.

17. The apparatus as recited in claim 15 wherein the pressure differential is selectively created across the pressure control member by establishing a pressure uphole of the downhole robot that is greater than a pressure downhole of the downhole robot.

18. The apparatus as recited in claim 15 wherein the pressure differential is selectively created across the pressure control member by establishing a pressure downhole of the downhole robot that is greater than a pressure uphole of the downhole robot.

19. The apparatus as recited in claim 15 wherein the pressure control member has a running position.

20. A method for actuating a well tool in a wellbore, the method comprising the steps of:

positioning a downhole robot having a pressure control member and an engagement mechanism within the wellbore;

moving the downhole robot within the wellbore to a location proximate the well tool;

releasably engaging the engagement mechanism with the well tool;

creating a differential pressure across the pressure control member; and transmitting a longitudinal force with the engagement mechanism to actuate the well tool.

21. The method as recited in claim 20 wherein the step of moving the downhole robot further comprises the step of providing autonomous movement via a locomotor assembly.

22. The method as recited in claim 20 wherein the step of moving the downhole robot further comprises the step of providing electrical power via a self-contained power source associated with the downhole robot.

23. The method as recited in claim 20 further comprising the step of supplying control and power to the downhole robot via an umbilical cord.

24. The method as recited in claim 20 further comprising the step of controlling the operation of the downhole robot, the pressure control member and the engagement mechanism with a control unit associated with the downhole robot.

25. The method as recited in claim 20 further comprising the step of sensing the position of the downhole robot within the wellbore.

26. The method as recited in claim 20 wherein the step of releasably engaging the engagement mechanism with the well tool further comprises releasably engaging the engagement mechanism with a sliding sleeve flow control device.

27. The method as recited in claim 20 wherein the step of creating a differential pressure across the pressure control member further comprises creating a pressure uphole of the downhole robot that is greater than a pressure downhole of the downhole robot.

28. The method as recited in claim 20 wherein the step of creating a differential pressure across the pressure control member further comprises creating a pressure downhole of the downhole robot that is greater than a pressure uphole of the downhole robot.

29. The method as recited in claim 20 further comprising the step of removing the differential pressure across the pressure control member.

30. The method as recited in claim 20 further comprising the step of disengaging the engagement mechanism from the well tool.

31. A method for actuating a well tool in a wellbore, the method comprising the steps of:

positioning a downhole robot having a pressure control member and an engagement mechanism within the wellbore;

autonomously moving the downhole robot within the wellbore to a location proximate the well tool;

releasably engaging the engagement mechanism with the well tool;

deploying the pressure control member into sealing engagement with the wellbore;

creating a differential pressure across the pressure control member; and transmitting a longitudinal force with the engagement mechanism to actuate the well tool.

32. The method as recited in claim 31 wherein the step of autonomously moving the downhole robot further comprises the step of providing movement within the wellbore via a locomotor assembly.

33. The method as recited in claim 31 wherein the step of autonomously moving the downhole robot further comprises the step of providing electrical power via a self-contained power source associated with the downhole robot.

34. The method as recited in claim 31 further comprising the step of supplying control and power to the downhole robot via an umbilical cord.

35. The method as recited in claim 31 further comprising the step of controlling the operation of the downhole robot, the sleeve and the engagement member with a control unit associated with the downhole robot.

36. The method as recited in claim 31 further comprising the step of sensing the position of the downhole robot within the wellbore.

37. The method as recited in claim 31 wherein the step of creating a differential pressure across the pressure control member further comprises creating a pressure uphole of the downhole robot that is greater than a pressure downhole of the downhole robot.

38. The method as recited in claim 31 wherein the step of creating a differential pressure across the pressure control member further comprises creating a pressure downhole of the downhole robot that is greater than a pressure uphole of the downhole robot.

39. An apparatus for actuating a tool positioned within a tubular comprising:

a robot that provides locomotion within the tubular;

a pressure control member operably associated with the robot, the pressure control member having a deployed position; and an engagement mechanism operably associated with the robot that is releasably engageable with the tool such that when the engagement mechanism is engaged with the tool, the pressure control member is in the deployed position and a differential pressure is created thereacross, the robot transmits a longitudinal force to actuate the tool.

40. The apparatus as recited in claim 39 wherein the robot further comprises a locomotor assembly including a drive mechanism operable to contact the tubular.

41. The apparatus as recited in claim 39 wherein the robot further comprises a self-contained power source for providing electrical power.

42. The apparatus as recited in claim 39 further comprising an umbilical cord operably associated with the robot, the umbilical cord supplying control and power to the robot.

43. The apparatus as recited in claim 39 wherein the robot further comprises a control unit that provides for the operation of the robot, the pressure control member and the engagement mechanism.

44. The apparatus as recited in claim 39 wherein the robot further comprises a position sensor for determining the location of the robot within the tubular.

45. The apparatus as recited in claim 39 wherein the pressure control member further comprises a seal operable to radially expanded into a sealing engagement with the tubular when the pressure control member is in the deployed position.

46. The apparatus as recited in claim 39 wherein the pressure control member has a running position.

47. An apparatus for actuating a well tool within a wellbore comprising:

a downhole robot that provides locomotion within the wellbore;

a pressure control member operably associated with the downhole robot, the pressure control member includes a pair of oppositely disposed seals operable to allow the selective creation of bi-directional differential pressures when the pressure control member is in a deployed position; and an engagement mechanism operably associated with the downhole robot and releasably engageable with the well tool.

48. The apparatus as recited in claim 47 wherein the downhole robot further comprises a locomotor assembly including a drive mechanism operable to contact the wellbore.

49. The apparatus as recited in claim 47 wherein the downhole robot further comprises a self-contained power source for providing electrical power.

50. The apparatus as recited in claim 47 further comprising an umbilical cord operably associated with the downhole robot, the umbilical cord supplying control and power to the downhole robot.

51. The apparatus as recited in claim 47 wherein the downhole robot further comprises a control unit that provides for the operation of the downhole robot, the pressure control member and the engagement mechanism.

52. The apparatus as recited in claim 47 wherein the downhole robot further comprises a position sensor for determining the location of the downhole robot within the wellbore.

53. The apparatus as recited in claim 47 wherein a pressure differential is selectively created across the pressure control member when the pressure control member is in the deployed position by establishing a pressure uphole of the downhole robot that is greater than a pressure downhole of the downhole robot.

54. The apparatus as recited in claim 47 wherein a pressure differential is selectively created across the pressure control member when the pressure control member is in the deployed position by establishing a pressure downhole of the downhole robot that is greater than a pressure uphole of the downhole robot.

55. The apparatus as recited in claim 47 wherein the pressure control member has a running position.

56. An apparatus for actuating a well tool within a wellbore comprising a downhole robot that provides locomotion within the wellbore;

a pressure control member operably associated with the downhole robot, wherein a pressure differential is selectively created across the pressure control member when the pressure control member is in a deployed position by establishing a pressure uphole of the downhole robot that is greater than a pressure downhole of the downhole robot; and an engagement mechanism operably associated with the downhole robot and releasably engageable with the well tool.

57. The apparatus as recited in claim 56 wherein the downhole robot further comprises a locomotor assembly including a drive mechanism operable to contact the wellbore.

58. The apparatus as recited in claim 56 wherein the downhole robot further comprises a self-contained power source for providing electrical power.

59. The apparatus as recited in claim 56 further comprising an umbilical cord operably associated with the downhole robot, the umbilical cord supplying control and power to the downhole robot.

60. The apparatus as recited in claim 56 wherein the downhole robot further comprises a control unit that provides for the operation of the downhole robot, the pressure control member and the engagement mechanism.

61. The apparatus as recited in claim 56 wherein the downhole robot further comprises a position sensor for determining the location of the downhole robot within the wellbore.

62. The apparatus as recited in claim 56 wherein the pressure control member further comprises a seal operable to radially expanded into a sealing engagement with the wellbore when the pressure control member is in the deployed position.

63. The apparatus as recited in claim 56 wherein the pressure control member has a running position.

64. The apparatus as recited in claim 56 wherein the pressure control member further comprises a pair of oppositely disposed seals operable to allow the selective creation of bi-directional differential pressures.

65. An apparatus for actuating a well tool within a wellbore comprising:

a downhole robot that provides locomotion within the wellbore;

a pressure control member operably associated with the downhole robot, wherein a pressure differential is selectively created across the pressure control member when the pressure control member is in a deployed position by establishing a pressure downhole of the downhole robot that is greater than a pressure uphole of the downhole robot; and an engagement mechanism operably associated with the downhole robot and releasably engageable with the well tool such that when the engagement mechanism is engaged with the well tool, the pressure control member is in the deployed position and the differential pressure is created thereacross, the downhole robot transmits a longitudinal force to actuate the well tool.

66. The apparatus as recited in claim 65 wherein the downhole robot further comprises a locomotor assembly including a drive mechanism operable to contact the wellbore.

67. The apparatus as recited in claim 65 wherein the downhole robot further comprises a self-contained power source for providing electrical power.

68. The apparatus as recited in claim 65 further comprising an umbilical cord operably associated with the downhole robot, the umbilical cord supplying control and power to the downhole robot.

69. The apparatus as recited in claim 65 wherein the downhole robot further comprises a control unit that provides for the operation of the downhole robot, the pressure control member and the engagement mechanism.

70. The apparatus as recited in claim 65 wherein the downhole robot further comprises a position sensor for determining the location of the downhole robot within the wellbore.

71. The apparatus as recited in claim 65 wherein the pressure control member further comprises a seal operable to radially expanded into a sealing engagement with the wellbore when the pressure control member is in the deployed position.

72. The apparatus as recited in claim 65 wherein the pressure control member has a running position.

73. The apparatus as recited in claim 65 wherein the pressure control member further comprises a pair of oppositely disposed seals operable to allow the selective creation of bi-directional differential pressures.

* * * * *